United States Patent [19]

Smith

[11] 4,332,382

[45] Jun. 1, 1982

[54] BOWLING AID

[76] Inventor: Eugene P. Smith, 1818 Sheffield Dr., Akron, Ohio 44320

[21] Appl. No.: 244,204

[22] Filed: Mar. 16, 1981

[51] Int. Cl.[3] ..... A63B 69/00

[52] U.S. Cl. ..... 273/54 B; 2/161 A; 128/88

[58] Field of Search ..... 273/54 B, 189 A; 2/161 A; 128/88, 89 R

[56] References Cited

U.S. PATENT DOCUMENTS

| | | | |
|---|---|---|---|
| 1,728,679 | 9/1929 | Hansard | 273/54 B UX |
| 3,829,090 | 8/1974 | Ensinger | 273/54 B |
| 3,970,305 | 7/1976 | Hawkins | 273/54 B |
| 4,183,098 | 1/1980 | Knowles | 273/54 B X |
| 4,190,906 | 3/1980 | Patton | 2/161 A |

*Primary Examiner*—Anton O. Oechsle
*Attorney, Agent, or Firm*—Joseph Januszewicz

[57] ABSTRACT

The present invention is directed to a bowling aid which is secured to the hand of a bowler, encompassing the palm portion, wrist portion and the back of the hand. The palm and wrist portion of the bowling aid have aligned elongated rigid plate members that permit bending at a point that is close to their juncture. The back of the hand and the wrist portion of the bowling aid also have aligned elongated rigid plate members that permit bending at a point that is close to their juncture. Adjusting means are disposed in the palm portion, wrist and back of the hand portions of the aid to bend the bowler's hand in preselected desired angles and lock the position so selected.

8 Claims, 6 Drawing Figures

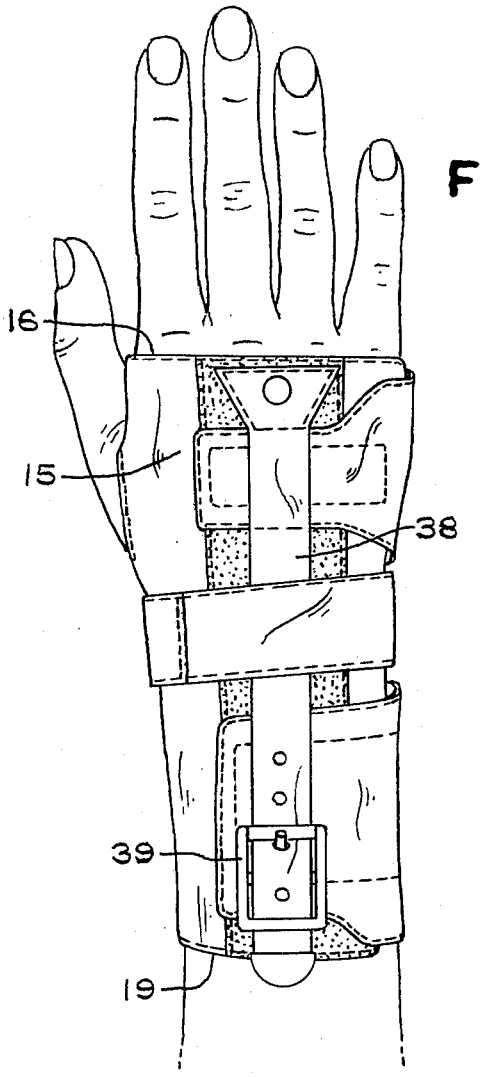
FIG. 2
FIG. 3
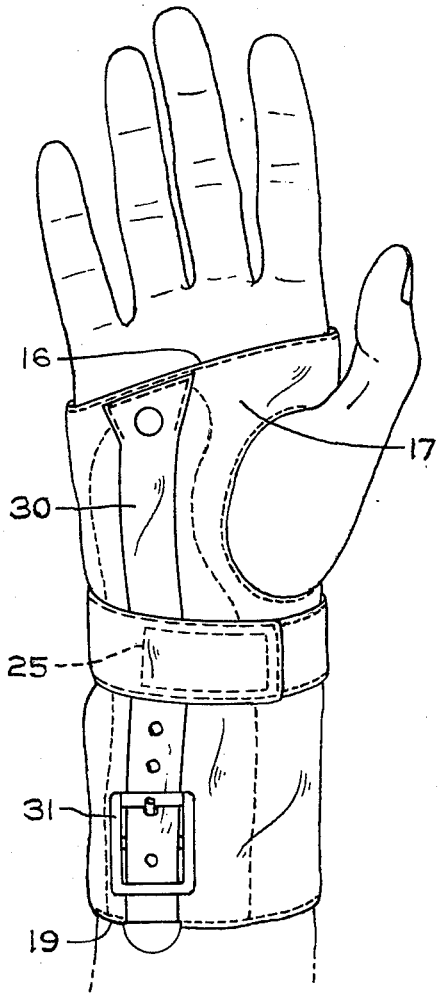

FIG. 5
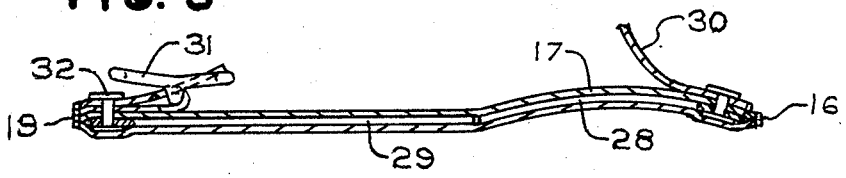
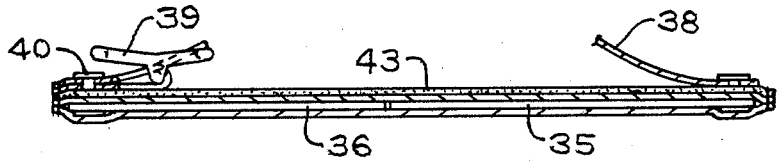
FIG. 6

BOWLING AID

Bowling balls are constructed with a hole for the thumb and two spaced holes for the middle fingers. When such a ball is gripped by the hand and then swung through an arc by the bowler, the position of the ball relative to the wrist and palm may change because of the weight of the ball and the manner in which the ball is delivered by the bowler to the alley or the bowling lanes. In addition, the condition of the alley will dictate the manner in which the ball should be delivered. By condition of the alley is meant whether the alley or lanes are dry or slick. When the lanes are dry, the bowling ball will have a tendency to hook to a greater extent than when the lanes are slick or oily. Accordingly, the bowler will have to adjust the amount of spin on his ball to either slow down the hook or increase its spin to achieve the desired hook. In addition, the ball is given spin to increase pin action. In any event, it is necessary for the bowler to be able to change the delivery of the ball to control the spin on the ball. One of the means for achieving this control has been to provide a wrist support which locks the wrist and palm into a rigid relationship such that the wrist, palm and bowling ball are always retained in the same position. Since these devices provide no means to change the angle between the wrist and palm, their effectiveness is limited. Due to different conditions of the lanes and the fact that these conditions change during bowling it is important for the bowler to be able to adjust the position of the palm relative to the wrist to be able to control the spin on the ball. Some refer to top spin, delivering a flat ball or over-spin; however, the important point is that some adjustment of the position of the palm relative to the hand must be available to the bowler to control spin and further that this adjustment must be reproduceable consistently. It is an object of the present invention to provide means for locking the position of the palm relative to the wrist and forearm while permitting controlled adjustment of this condition. It is a further object of this invention to provide a positive means to control the angular disposition of the palm to the wrist and forearm to permit adjustment in either direction selectively. This selective adjustment must be able to pull the palm forwardly as well as rearwardly of the wrist and then rigidly maintain this condition for that period of bowling that is required of it with means to adjust as desired or as situations dictate. An additional benefit of the present invention is that it gives the bowler the feeling and ability to throw the bowling ball with the whole arm and not just the hand and fingers.

SUMMARY OF THE INVENTION

The present invention contemplates a bowling aid that provides a flexible band or strip member that is wrapped around the bowler's palm, hand, wrist and the adjacent forearm. The strip member has a pair of rigid narrow plate members on the palm side and the back of the hand side that extends onto the wrist with the adjacent aligned ends permitting bending thereof. The pair of plate members are on opposite sides of the hand. Strap members and buckles are also mounted on opposite sides of the hand to permit selective cooperative adjustment and locking to a preselected angle of disposition of the palm relative to the wrist.

BRIEF DESCRIPTION OF THE DRAWINGS

FIG. 2 is a plan view of the back of a hand, wrist and forearm showing the bowling aid in position thereon.

FIG. 3 is a plan view of the front of a palm, wrist and forearm showing the bowling aid in position thereon.

FIG. 5 is a cross-sectional view of the bowling aid taken along line 5—5 of FIG. 4.

FIG. 6 is a cross-sectional view of the bowling aid taken along line 6—6 of FIG. 4.

DETAILED DESCRIPTION

Figure 1:
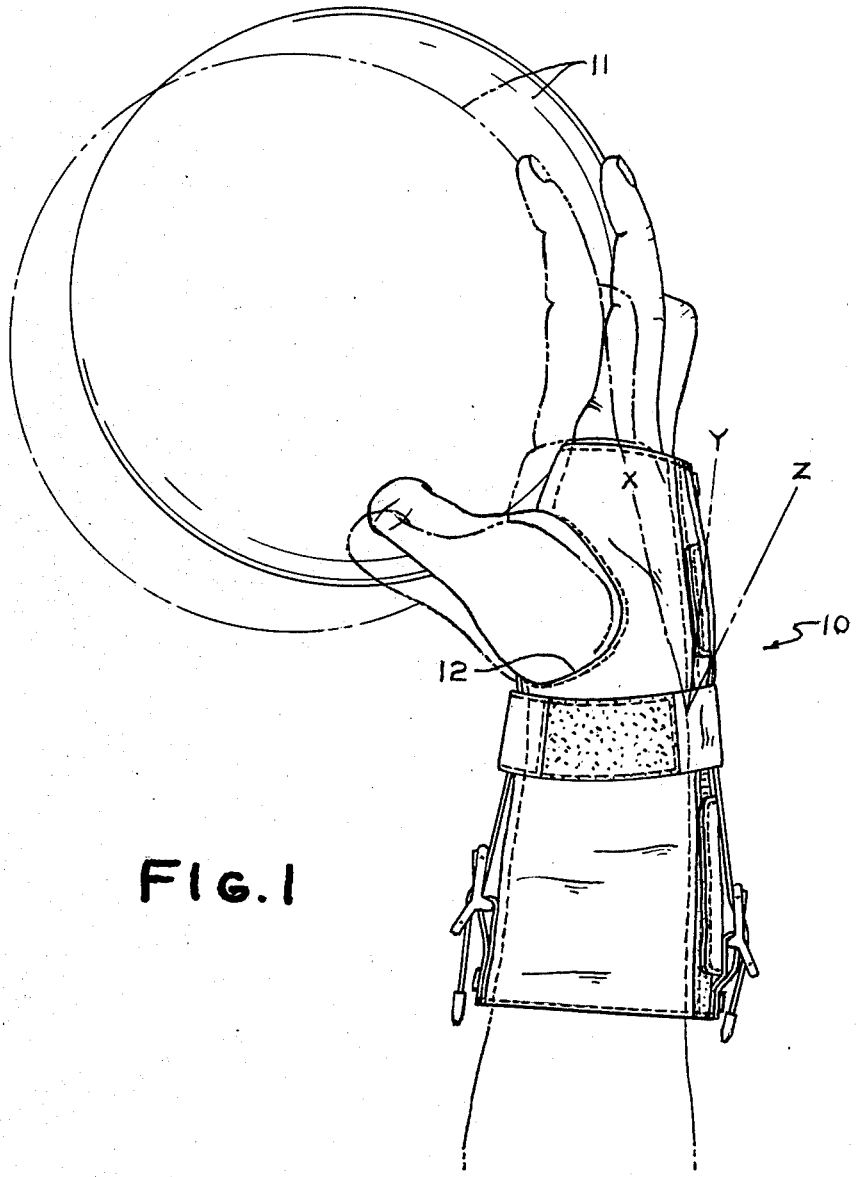
FIG. 1 is a side elevational view of the bowling aid strapped to the wrist disclosing the relationship of the bowling ball relative to the palm, wrist and forearm.

Referring to the drawings wherein like reference numerals refer to like and corresponding parts throughout the several views, there is shown in FIG. 1 the bowling aid 10 secured to a bowler's hand, wrist and forearm with the hand thereof supporting a bowling ball 11.

The bowling aid 10 has a comparatively wide strip of material made as from leather, Naugahide®, flexible plastic material or some similar material that has some body or stiffness.

Figure 4:
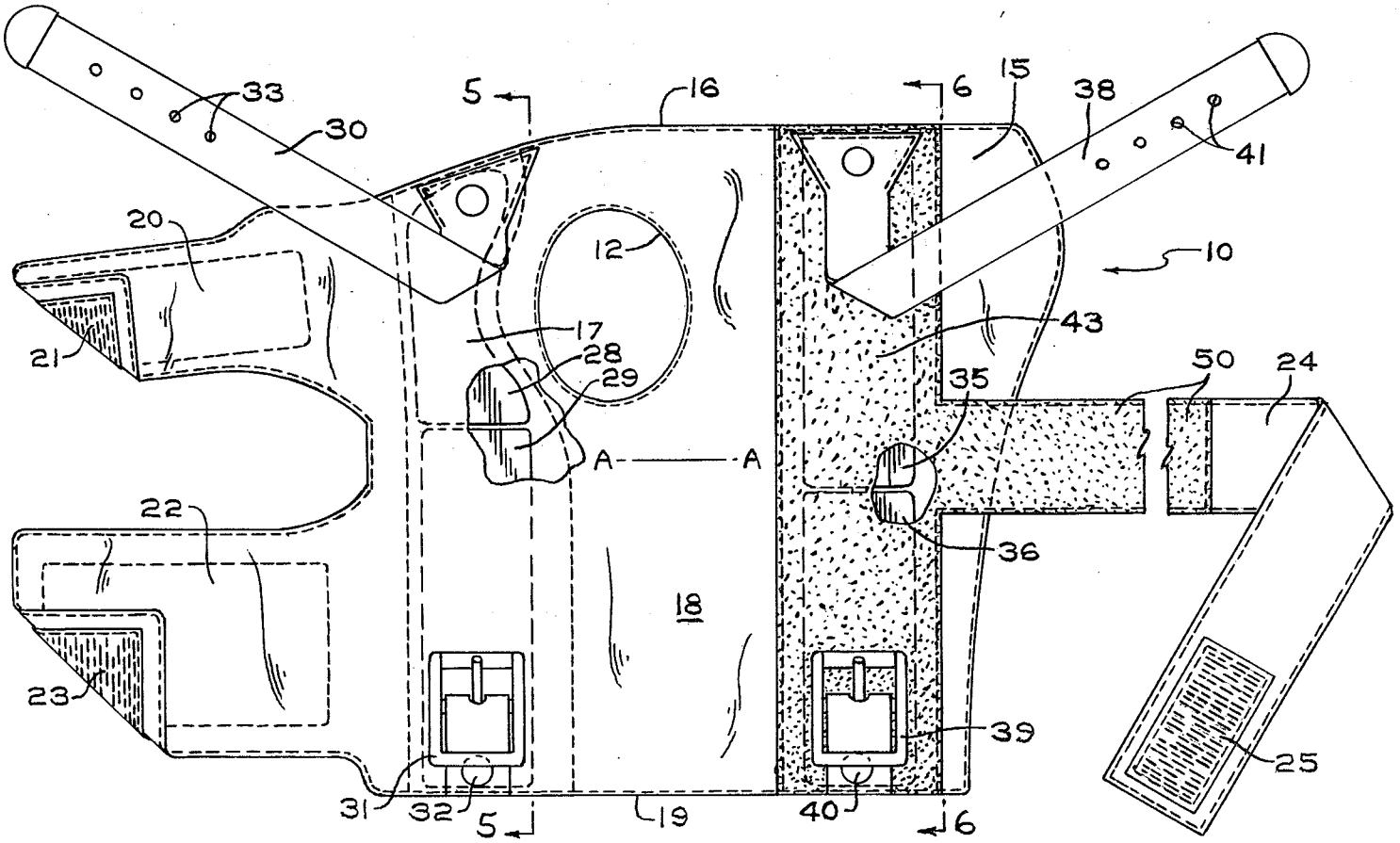
FIG. 4 is a top plan view of the bowling aid with a portion thereof broken away.

The strip of material has a thumb hole 12 to receive the thumb of the bowler, permitting the wrapping of the strip of material around the hand, wrist and forearm adjacent the wrist of the bowler. The strip of material is sufficiently long on the hand portion thereof to cover the back of the hand to form a back hand portion 15 (FIG. 2) with an upper edge 16 that is closely adjacent the knuckles of the hand. The strip of material also covers a major portion of the palm of the hand to form a palm portion 17 with an upper edge 16 that is the continuation of the upper edge 16 of the back hand portion 15. The lower and intermediate portion of the strip material is referred to as the wrist portion 18 and covers the wrist and that portion of the forearm closely adjacent the wrist. As indicated in FIG. 4, a medium line A—A extends transversely across the strip of material and is equidistant between the upper edge 16 and a lower edge 19 on the wrist portion 18. The thumb hole 12 is located in the palm portion 17 substantially equidistant between the upper edge 16 and medium line A—A.

The palm portion 17 opposite the thumb hole 12 has a laterally extending strip 20 with a piece of VELCRO strip designated 21 secured to the inner side thereof as by bonding with a suitable adhesive or by sewing. VELCRO strip is a trademark referring to fabric material that is well known in the fastening art and utilizes a pair of strips, one of which has a surface of loosely felted elements that cooperate with and fasten to closely spaced hook elements on the other strip when the strips are pressed together. The cooperative strips can be separated by pulling them apart but resist separation if the force of separation is across the surfaces thereby making them ideal for bowling aids and gloves relying on straps for fastening. The wrist portion of the strip material below the palm portion has a laterally extending strip 22 with a piece of VELCRO designated 23 secured to the inner surface thereof. The wrist portion adjacent the back hand portion has an elongated strip 24 of flexible material extending laterally outwardly therefrom with a piece of VELCRO® strip 25 secured to one side thereof to facilitate securing of the bowling aid to the hand of the bowler.

The palm portion of the strip material has a first narrow width rigid plate member 38 extending from the upper edge 16 thereof towards the medium line A—A but terminating just below the thumb hole and closely adjacent the wrist portion. A second narrow width rigid plate member 29 in alignment with the first plate member 28, extends from a point closely adjacent the lower end of the plate member 28 down across the wrist portion 18 to a point closely adjacent the lower edge of the wrist portion. An elongated strap member 30 is suitably riveted to the first plate member 28 and palm portion 17 closely adjacent the upper edge 16 and extends past the lower edge 19 of the wrist portion. A buckle 31 is suitably riveted as at 32 to the plate member 29 adjacent the lower edge 19 of the wrist portion. The strap 30 has a plurality of holes 33 that cooperate with the buckle 31 for a purpose to be described. The back hand portion 15 has a third narrow width rigid plate member 35 extending from the upper edge 16 to a point slightly below the medium line A—A in the wrist portion 18. A fourth narrow width rigid plate member 36 in alignment with the third narrow width rigid plate member 35 extends from a point closely adjacent the lower end of the plate member 35 down across the wrist portion 18 to a point closely adjacent the lower edge 19 of the wrist portion. The first and second plate members 28 and 29 are generally parallel to the third and fourth plate members 35 and 36. Plate member 28, 29, 35, and 36 are generally normal to the lower edge 19. The small gap between the first plate member 28 and the second plate member 29 as well as the third plate member 35 and the fourth plate member 36 permit controlled bending of the bowling aid about these gaps.

An elongated strap member 38 is suitably riveted to the third plate member 35 and the back hand portion 15 closely adjacent the upper edge 16 and extends past the lower edge 19 of the wrist portion 18. A buckle 39 is suitably riveted as at 40 to the plate member 36 adjacent the lower edge 19. The strap 38 has a plurality of holes 41 that selectively cooperate with the buckle 39 for a purpose to be discribed. A longitudinal strip of VELCRO 43 overlying the respective plate members 35 and 36 is suitably sewn to the back hand portion 15 and the wrist portion 18 to provide means for securing the bowling aid 10 to the hand and wrist of the bowler in cooperation with the VELCRO strips 21, 23 and 25 on the laterally extending strips 20, 22 and 24.

The bowler inserts his thumb through the opening or thumb hole 12, then wraps the straps 20 and 22 around the back of the hand and over the back hand portion 15, which is resting on the back of the hand until the VELCRO strip 21 engages the VELCRO strip 43 and the strip 23 engages the strip 43. The respective elongated strap members 30 and 38 are secured to their respective buckles 31 and 39. The elongated laterally extending strip 24 is then wrapped around the palm portion over the back of the hand or back portion of the bowling aid and thence around to the palm portion such that the VELCRO strip 25 engages a corresponding VELCRO strip 50 that is on the outer surface of strip 25. It is to be noted that the VELCRO strip 50 on the outer surface of the strip 24 extends for a considerable distance to accommodate the wrapping of the strip 25 as described. As seen in FIG. 2, the strap or strip 25 can be substantially the width or spacing between adjacent edges of the straps 20 and 22 to provide additional rigidity to the bowling aid. As described, with the elongated strap members 30 and 38 fastened to the buckles, the hand and wrist is locked in a straight angle or line Y as indicated in FIG. 1. On loosening up of the strap member 38 on the back portion of the bowling aid and on tightening up of the strap member 30 on the palm portion the hand will be locked into an angle wherein the palm is disposed forwardly as shown in the phantom lines of FIG. 1 on a line X as indicated in FIG. 1. The amount of loosening up on the strap members 30 and 38 will determine the degree of the angle between the palm and the wrist. It is to be noted that the wrist portion of the bowling aid extends up onto the forearm portion and that, although the word wrist is used, it is to be understood that this word "wrist" includes a corresponding portion of the forearm that is adjacent the wrist. This extension of the wrist support provides a support to the hand (palm, back of the hand and fingers) to prevent fatigue and a feeling that the entire arm as a unit functions to support and deliver the bowling ball. Once the straps 30 and 38 are received in their respective buckles 31 and 39, the hand is locked in a preselected position. Where a bowler desires to throw a flatter ball or a delivery with less curve, the strap 38 in the palm is loosened and the strap 38 on the back hand portion 15 is tightened to where the upper portion of the hand (palm and back of the hand) is bent rearwardly or rightwardly as viewed in FIG. 1 to a line Z from line Y. This degree of adjustment is selected and can be adjusted to that desired by the bowler thereby providing a variable controlled adjustment.

The invention as described above is the preferred embodiment and it will be obvious to those skilled in the art that various changes and modifications can be made without departing from the spirit thereof, and therefore only such limitations shall be placed thereon as are specifically set forth in the appended claims:

I claim:

1. A bowling aid for supporting the bowler's hand and wrist at preselected angles relative to each other comprising a strip member of flexible material; means for securing said strip member around a bowler's hand, said strip member having a palm portion, back hand portion and a wrist portion; said palm portion having a thumb hole for receiving the thumb of a bowler; said strip member having an upper edge that extends along said palm portion and said back hand portion; said strip member having a lower edge that extends in a direction generally parallel to said upper edge and along the bottom of said wrist portion; a pair of laterally spaced elongated rigid plate members secured to said strip member in general parallel relationship; one of said plate members extending from said upper edge on said palm portion to said lower edge; the other one of said plate members extending from said upper edge on said back hand portion to said lower edge and being normal to said lower edge; each of said plate members having a gap intermediate their ends to permit pivoting of said palm portion and said back hand portion about said gap; and adjustable strap means overlying each of said plate members for the full length thereof for selective shortening and lengthening to pivot said palm portion and said back hand portion relative to said wrist portion.

2. A bowling aid as set forth in claim 1 wherein said thumb hole is equidistant between said upper edge and a medium line across said strip member.

3. A bowling aid as set forth in claim 2 wherein said means for securing said flexible strip member to a bowler's hand includes a flexible strap that overlies said strap means intermediate their respective ends providing equal portions of said strap means above and below said flexible strap means.

4. A bowling aid as set forth in claim 3 wherein said flexible strap is a wide strap member that encircles said wrist portion providing support for said wrist and said strap means.

5. A bowling aid for supporting a bowler's hand and wrist comprising: a strip member of flexible material for wrapping around the hand and wrist of a bowler; means for securing said strip member in an oval shape around the wrist and hand; said member having an upper edge extending along the upper palm and the back of the hand; said member having a lower edge extending around the wrist; said member having a thumb hole for receiving the thumb of a bowler; a first and a second rigid member aligned end to end on one side of said thumb hole extending along said palm and wrist from said upper edge to said lower edge; a third and a fourth rigid member aligned end to end on the opposite side of said thumb hole extending from said upper edge to said lower edge; said first and said second members having a gap therebetween to allow pivoting of said first member relative to said second member; said fourth and said third member having a gap therebetween to allow pivoting of said third member relative to said fourth member; adjustable strap means overlying said first and said second aligned rigid members; adjustable strap means overlying said third and said fourth rigid members; and said adjustable strap means operative to hold said first and said second rigid members along with said third and said fourth rigid members in preselected angles.

6. A bowling aid for supporting a bowler's hand and wrist as set forth in claim 4 wherein said securing means includes three strap members; one of said strap members operative to stiffen said palm and said back side of the hand; a second one of said strap members operative to stiffen said wrist and the forearm of a bowler adjacent the wrist; and a third one of said strap members intermediate said first and said second strap members to encircle said wrist.

7. A bowling aid for supporting a bowler's hand and wrist at preselected angles relative to each other comprising a strip member of flexible material for encircling the palm, hand and wrist of a bowler to form a circumferentially extending support; said member having a palm portion, a back hand portion, and a wrist portion; said wrist portion encompasses the wrist; said palm portion having an upper edge and a thumb hole for receiving the thumb of a bowler; said back hand portion having an upper edge coextensive with said upper edge of said palm portion; said wrist portion having a first lower edge that is directly opposite said upper edge of said palm portion; said wrist portion having a second lower edge that is directly opposite said upper edge of said back hand; said strip member having a first rigid elongated member extending from said upper edge of said palm portion to said first lower edge on said wrist portion; said strip member having a second rigid elongated member substantially parallel to said first rigid member; said second rigid member extending from said upper edge of said back hand portion to said second lower edge on said wrist portion; each of said rigid elongated members having a gap extending transversely of said members closely adjacent the junctures of said wrist portion with said palm portion and said hand portion respectively; means for securing said strip member onto the palm, hand and wrist of a bowler as said member is wrapped on a bowler's hand; and adjusting means on said palm portion and said back hand portion that extends respectively to said wrist portion to adjust the angular relationship of said palm portion and said back hand portion relative to said wrist portion.

8. A bowling aid as set forth in claim 7 wherein said means for securing said strip member onto said wrist of a bowler includes a wide strap that maintains said adjusting means closely adjacent to said strip member.

* * * * *